United States Patent [19]

Takahashi

[11] Patent Number: 4,825,120

[45] Date of Patent: Apr. 25, 1989

[54] ELECTRON GUN APPARATUS WITH AUXILIARY ELECTRODES FOR A COLOR CATHODE-RAY TUBE

[75] Inventor: Yoshiaki Takahashi, Chiba, Japan

[73] Assignees: Hitachi, Ltd.; Hitachi Device Eng. Co. Ltd., both of Tokyo, Japan

[21] Appl. No.: 111,286

[22] Filed: Oct. 22, 1987

[30] Foreign Application Priority Data

Oct. 22, 1986 [JP] Japan ..... 61-249716

[51] Int. Cl.[4] ..... H01J 29/46; H01J 29/56

[52] U.S. Cl. ..... 313/414; 313/449; 315/15

[58] Field of Search ..... 313/414, 449, 458, 460; 315/14, 15, 16, 382

[56] References Cited

U.S. PATENT DOCUMENTS 4,712,043 12/1987 Takenaka et al. ..... 313/414 X

FOREIGN PATENT DOCUMENTS 13769 1/1979 Japan .

*Primary Examiner*—Kenneth Wieder

*Attorney, Agent, or Firm*—Antonelli, Terry & Wands

[57] ABSTRACT

In an electron gun apparatus for color cathode-ray tube, first and second focusing electrodes respectively for focusing electron beams emitted from three electron guns are disposed. Between the first and second focusing electrodes, a pair of third focusing electrodes for forming an axial-nonsymmetrical electron lens are also disposed. Mutually different dynamic voltages are supplied to the third focusing electrodes in accordance with the change in deflection angle of the electron beam. Owing to the above described structure, uniform resolution is obtained at both the central part and the peripheral part of the screen.

7 Claims, 4 Drawing Sheets

ELECTRON GUN APPARATUS WITH AUXILIARY ELECTRODES FOR A COLOR CATHODE-RAY TUBE

BACKGROUND OF THE INVENTION

The present invention relates to an electron gun apparatus for a color cathode-ray tube, and in particular to the structure of focusing electrodes for in-line electron guns which emit three electron beams in line and which are mounted on a color cathode-ray tube of shadow mask type.

In general, an electron gun apparatus for a color cathode-ray tube includes three electron guns having a plurality of grid electrodes. Electrostatic lenses are formed between grid electrodes by applying a predetermined voltage to respective grid electrodes. This electrostatic lens focuses an electron beam flux to make it strike against the fluorescent screen of the color cathode-ray tube. In order to deflect and concentrate the electron beam fluxes emitted from three electron guns to the entire surface of the fluorescent screen, deflection yokes of saddle type or toroid type are used. This deflection yoke distorts the distribution of the horizontal deflection magnetic field into a pincushion shape and distorts the distribution of a vertical deflection magnetic field into a barrel shape. This deflection yoke simplifies the structure of a convergence device because of its self-convergence effect.

While a round shaped beam spot 2 is projected onto the central part of a screen 1 formed by a fluorescent screen as shown in FIG. 7, however, a beam spot 3 distorted in a nonround shape is obtained at the peripheral part of the screen 1, resulting in a degraded resolution at the peripheral part of the screen. Such degradation in resolution caused by the deflection distortion can be mitigated by reducing the diameter of the electron beam passing through the main electron lens of the electron gun and the deflection magnetic field. In this case, however, the gap between the cathode and the main electron lens of the electron gun is narrowed. If a method of converging the electron beam by using a prefocus lens is adopted, the multiplying factor of the main electron lens becomes large and hence the diameter of the beam spot appearing in the central part of the screen becomes large, resulting in degraded resolution of the entire screen.

Electron guns as shown in FIG. 8 have been proposed to mitigate the above described problem. In FIG. 8, a first grid 11, a second grid 12, a third grid 13 and a fourth grid 14 respectively having apertures corresponding to three electron beams emitted from three cathodes 10R, 10G and 10B are successively disposed at predetermined intervals in a direction approaching a screen (not illustrated). Each numeral representing a grid attached with a suffix R, G or B denotes an aperture functioning as a hole for passing the electron beam through it. For each of apertures 11R, 11G and 11B of the first grid 11, apertures 12R, 12G and 12B of the second grid 12, and apertures 13R, 13G and 13B of the third grid 13, a single electrostatic lens is formed to function as a prefocus lens. Between the third grid 13 and the fourth grid 14, electrostatic lenses having large apertures are formed to function as the main electron lenses. In such a structure, partition plates **13*a* and 13*b* are disposed between cylindrical portions having three apertures 13R', 13G' and 13B' in the third grid 13 forming the main electron lenses. Because of these partition plates, electrostatic lenses formed in three apertures 13R', 13G' and 13B' of the third grid 13 are so distorted as to be longer in the vertical direction as shown in FIG. 9**.

In this electrostatic lens so distorted as to be longer in the vertical direction, the focusing force Fn in the horizontal direction is larger than the focusing force Fv in the vertical direction as shown in FIG. 9. As a result, the electron beam is so shaped as to be longer in the vertical direction at the central part of the screen.

When such a structure is used, the aberration of the beam spot in the vertical direction is lightened at the peripheral part of the screen. As shown in FIG. 10, therefore, a round shaped beam spot 2 can be formed at the peripheral part of the screen 1.

The structure of such an electron gun for color cathode-ray tube is disclosed in JP-A-No. 54-13769, for example.

In electron guns for color cathode-ray tube having the structure heretofore described, however, a beam spot 4 formed at the central part of the screen 1 has a nonround shape (elongated in the vertical direction). Accordingly, the resolution in the horizontal direction is degraded. As a result, the resolution of the entire screen 1 cannot be raised. In other words, the resolution at the central part of the screen is different from that at the peripheral part of the screen. Means for solving these problems have thus been demanded.

SUMMARY OF THE INVENTION

The present invention has been obtained in view of these circumstances.

An object of the present invention is to provide an electron gun apparatus for a color cathode-ray tube having uniformly improved resolution at both the central part and the periphery of the screen.

The object of the present invention is achieved by disposing a pair of auxiliary electrodes forming an axial-nonsymmetrical lens, i.e., a lens which is not symmetrical with respect to the axis, between the focusing electrodes forming the main electron lenses.

In accordance with the present invention, dynamic voltages which are different from each other are applied to a pair of auxiliary electrodes with the change of the deflection angle of the electron beam, an axial-nonsymmetrical lens being formed between the auxiliary electrodes.

Further, in accordance with the present invention, two auxiliary electrodes are so disposed as to be opposed to each other between bisected focusing electrodes forming the main lenses, and a groove for shaping the electron beam so as to become longer in the vertical direction is disposed near the electron beam passing hole on at least one of the opposed faces of the auxiliary electrodes. In addition, voltages which are different from each other and which are varied on the basis of the deflection angle of the electron beam are applied to respective auxiliary electrodes. Thus, a nonsymmetrical lens is formed between the auxiliary electrodes. It is thus possible to obtain fine resolution over the entire screen without changing the lens multiplying factor of the entire electron gun.

BRIEF DESCRIPTION OF THE DRAWINGS

FIG. 4(*e*) shows voltage supply in the operation of the present invention.

DESCRIPTION OF THE PREFERRED EMBODIMENTS

Embodiments of the present invention will now be described by referring to drawings.

Figure 1:
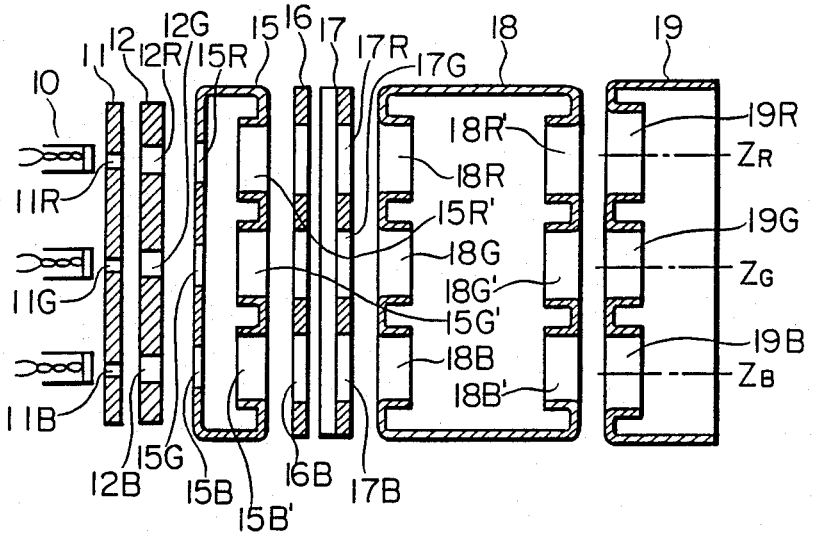
FIG. 1 is a cross sectional view of an embodiment of an electron gun apparatus for a color cathode-ray tube according to the present invention.
Figure 2:
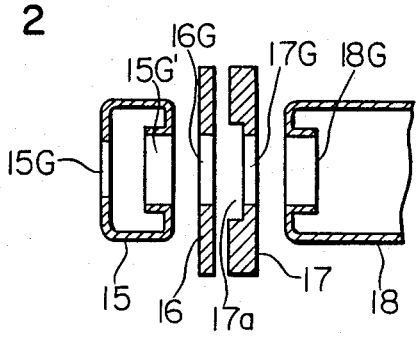
FIG. 2 is a longitudinal sectional view of a principal part of the electron gun apparatus illustrated in FIG. 1.
Figure 3:
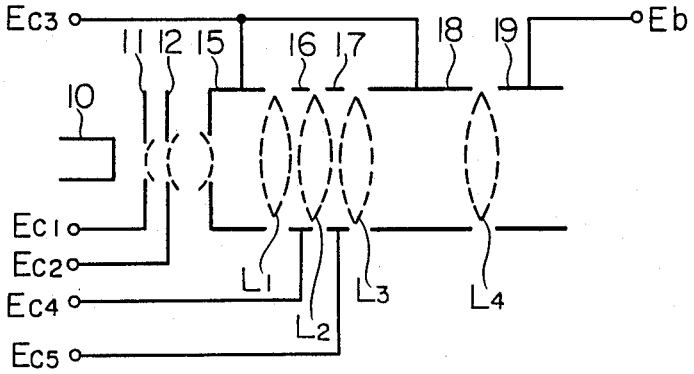
FIG. 3 is a schematic view for illustrating the voltage supply when the electron gun according to the present invention is operated.
Figure 4A:
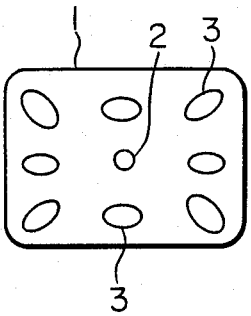
FIGS. 4(*a*), (*b*), (*c*) and (*d*) are schematic views of beam spots appearing on the screen of a color cathode-ray tube using electron guns according to the present invention.
Figure 4B:
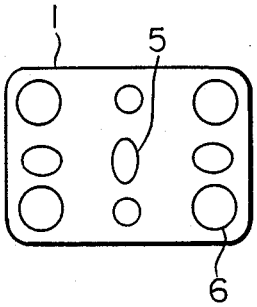
Figure 4C:
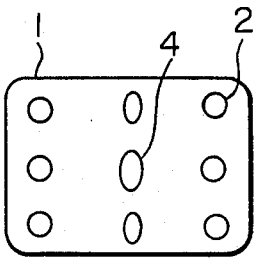
Figure 4D:
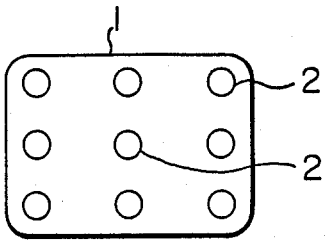
Figure 4E:
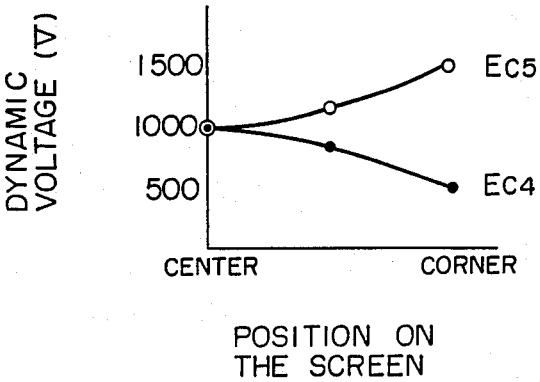

FIG. 1 is a sectional view showing an embodiment of an electron gun apparatus for a color cathode-ray tube according to the present invention. Parts which are the same as those shown in the above described drawings are denoted by like symbols. In FIG. 1, a third grid 15, a fourth grid 16, a fifth grid 17, a sixth grid 18 and a seventh grid 19 for concentrating the electron beam are so successively arranged at predetermined intervals in a direction approaching a screen (not illustrated) as to be opposed to the second grid 12. In the same way as the drawings described before, a suffix R, G or B added to each grid denotes an aperture functioning as a hole for passing an electron beam through it. On a face of the fifth grid 17 opposed to the fourth grid 16, a groove 17*a* concave in a direction perpendicular to the direction wherein the electron beam travels as shown in FIG. 2 is formed. Apertures 17R, 17G and 17B are formed on the bottom of the groove 17*a*. Among three apertures 19R, 19G and 19B of the seventh grid 19, only apertures 19R and 19B located at both sides respectively have eccentric central axes $Z_R$ and $Z_B$ outside for achieving static convergence. First electrostatic lenses are formed between the third grid 15 and the fourth grid 16. Second electrostatic lenses are formed between the fourth grid 16 and the fifth grid 17. Third electrostatic lenses are formed between the fifth grid 17 and the sixth grid 18. Fourth electrostatic lenses are formed between the sixth grid 18 and the seventh grid 19. These electrostatic lenses function as main electron lenses, respectively.

When the electron gun apparatus having such a structure is operated, the first grid 11, the second grid 12 and the third grid 15 are supplied with $E_{c1}=0$ V, $E_{c2}=600$ V and $E_{c2}=7$ kV, respectively. The sixth grid 18 is also supplied with $E_{c3}=7$ kV. The fourth grid 16 and the fifth grid 17 are supplied with variable voltages having ranges represented as $E_{c4}=0$ to 2 kV and $E_{c5}=0$ to 2 kV. And the seventh grid 19 is supplied with high voltage represented as $E_b=25$ kV.

In such a structure, electron beams emitted from respective cathodes 10R, 10G and 10B are accelerated by the first grid 11 and the second grid 12, and then passed through main electron lenses $L_1$, $L_2$, $L_3$ and $L_4$ formed by the third grid 15, the fourth grid 16, the fifth grid 17, the sixth grid 18 and the seventh grid 19. The electron beams thus focused strike against a fluorescent screen (not illustrated).

Figure 5:
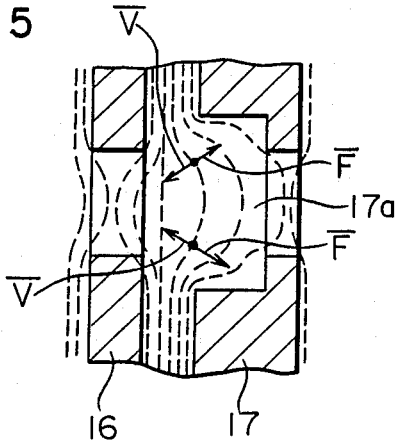
FIG. 5 shows equipotential lines formed between a fourth grid and a fifth grid according to the present invention.

If the voltage of 1 kV is applied to both the fourth grid 16 and the fifth grid 17, the potential difference (gradient) is absent between the fourth grid 16 and the fifth grid 17, and hence the electron lens $L_2$ is absent, resulting in an electron gun having axial-symmetrical lenses. As shown in FIG. 4(*a*), therefore, a round shaped beam spot 2 is formed at the central part of a screen 1. At the peripheral part of the screen, however, an elliptical beam spot 3 largely distorted by the deflection distortion is formed. If the voltage $E_{c4}$ applied to the fourth grid 16 is reduced by several hundred volts as compared with the above described value, the electron lens $L_2$ is formed between the fourth grid 16 and the fifth grid 17. At this time, a curved electrostatic lens is formed in a direction perpendicular to the track axis as shown in FIG. 5 by a concave groove 17*a* of the fifth grid 17. Since the potential of the fifth grid 17 is higher than that of the fourth grid 16, the potential vector $\overline{V}$ points to the track axis direction. The electron beam is subject to force $\overline{F}$ in such a direction that the beam is expanded with respect to the track axis. As shown in FIG. 4(*b*), therefore, a beam spot 5 which is longer in the vertical direction is formed at the central part of the screen 1, while a round shaped beam spot 6 is formed at the peripheral part of the screen 1. Since the voltage $E_{c4}$ of the fourth grid 16 has been lowered, however, the lens multiplying factor of the electron lens $L_1$ formed between the third grid 15 and the fourth grid 16 is increased, resulting in an increased beam spot diameter of the screen 1 as a whole. If the voltage $E_{c5}$ applied to the fifth grid 17 is increased by several hundred volts as compared with its initial preset value, the lens multiplying factor of the electron lens $L_3$ formed between the fifth grid 17 and the sixth grid 18 is reduced. It is thus possible to cancel the above described increase in the lens multiplying factor of the electron lens $L_1$ formed between the third grid 15 and the fourth grid 16. At this time, the astigmatism of the electron lens $L_2$ formed between the fourth grid 16 and the fifth grid 17 becomes further strong as compared with the above described case where the voltage $E_{c4}$ applied to the fourth grid 16 is lowered. As shown in FIG. 4(*c*), therefore, a beam spot 4 which is longer in the vertical direction is formed at the central part of the screen 1. At the peripheral part of the screen 1, a beam spot 2 having the same size as the beam spot formed at the central part of the screen as shown in FIG. 4(*a*) can be formed. If voltages as shown in FIG. 4(*e*) are respectively supplied to the fourth grid 16 and the fifth grid 17 in accordance with the deflection of the electron beam in the above described operation, it is possible to make the shape of the beam spot round at any location on the screen as shown in FIG. 4(*d*).

Figure 6:
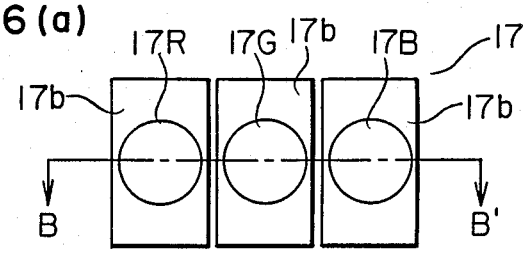
FIGS. 6(*a*) and (*b*) show another embodiment of electron guns according to the present invention.
Figure 6:
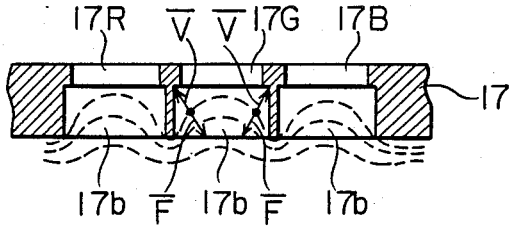
Figure 7:
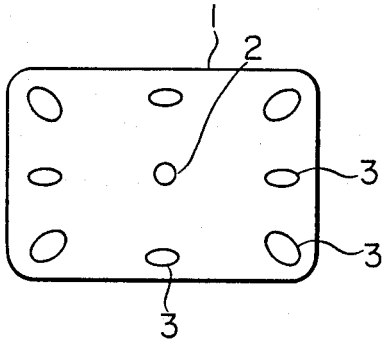
FIG. 7 PRIOR ART
FIGS. 7 to 10 show problems of conventional electron gun apparatuses for a color cathode-ray tube.
Figure 8:
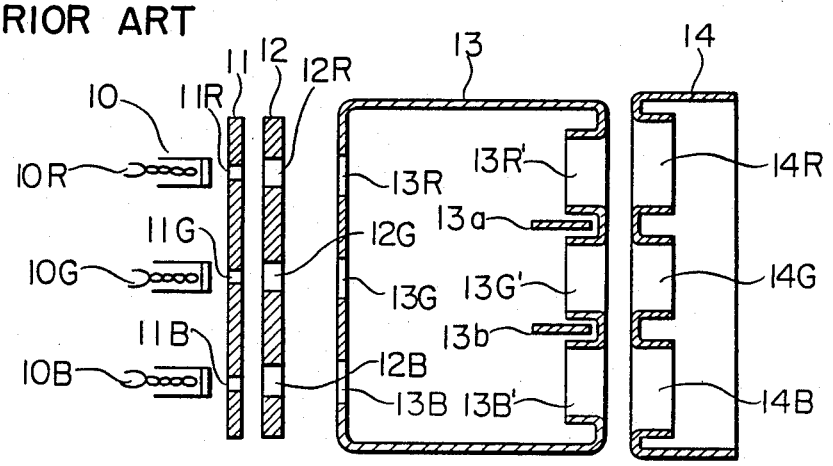
FIG. 8 PRIOR ART
Figure 9:
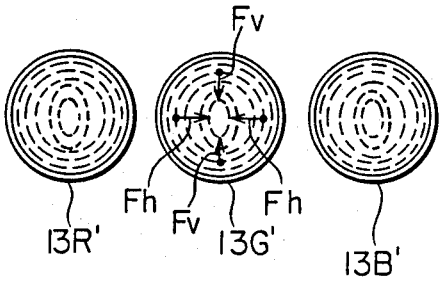
FIG. 9 PRIOR ART
Figure 10:
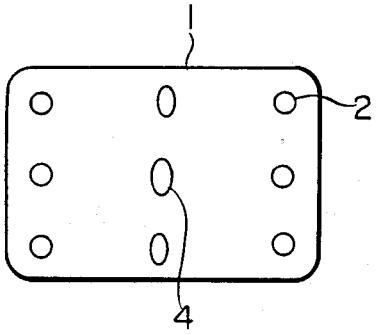
FIG. 10 PRIOR ART

FIG. 6 shows another embodiment of an apparatus according to the present invention. Instead of the above described concave groove 17*a* of the fifth grid 17, concave grooves 17*b* which are longer in the vertical direction are disposed around the apertures 17R, 17G and 17B, respectively. By lowering the voltage $E_{c5}$ supplied to the fifth grid and raising the voltage $E_{c4}$ supplied to the fourth grid 16, electrostatic lenses curved in the horizontal direction as compared with the vertical direction are formed in the grooves 17*b*. Since the electron beam is subject to strong focusing force $\overline{F}$ in the horizontal direction, a beam spot which is longer in the vertical direction can be formed at the center of the screen. The same effects as those of the embodiment described before are thus obtained.

In the embodiments described before, the concave groove 17*a* is disposed on the fifth grid 17 or the concave grooves 17*b* are disposed on the fifth grid 17. However, the present invention is not limited to such cases. The fourth grid 16 may have the same structure as that of the fifth grid 17. In this case, the same effects as those described before are obtained by raising the voltage $E_{c4}$ supplied to the fourth grid 16 and lowering the voltage $E_{c5}$ supplied to the fifth grid.

The above described concave groove 17*a* or concave grooves 17*b* may be disposed on either the fifth grid 17 or the fourth grid 16, and the concave groove 17*a* or each of the concave grooves 17*b* may have a combination of a lateral groove structure and a vertical groove structure. In this case, variable voltage values supplied to these structures can be reduced, and the same effects as those of the cases described before can be obtained.

I claim:

1. An electron gun apparatus for a color cathode-ray tube including an electron beam source having three electron guns arranged in line for emitting respective electron beams, and focusing electrodes for focusing electron beams emitted from said electron beam source onto a fluorescent screen of the color cathode-ray tube, comprising:

a pair of auxiliary electrodes so disposed between bisected parts of said focusing electrodes forming main electron lenses as to be opposed to each other, a concave groove for producing an axial-nonsymmetrical electron lens formed relative to each of the electron beams on at least one of opposed faces of said auxiliary electrodes; and means for applying mutually different dynamic voltage values to said auxiliary electrodes in accordance with the change in the deflection angle of the electron beam emitted from said electron beam source.

2. An electron gun apparatus according to claim 1, wherein said auxiliary electrodes include another concave groove different from said concave groove.

3. An electron gun apparatus according to claim 1, wherein said auxiliary electrodes include a first concave groove extending in the lateral direction on one of the opposed faces and a second concave groove extending in the vertical direction on the other of the opposed faces.

4. An electron gun apparatus for a color cathode-ray tube comprising:

electron beam emission means having three electron guns arranged in line for emitting respective electron beams;

a first focusing electrode forming a first focusing electron lens for focusing the electron beam emitted from said emission means with a first lens multiplying factor;

a second focusing electrode forming a second focusing electron lens for focusing the electron beam focused by said first electron lens with a second lens multiplying factor;

a pair of third focusing electrodes so disposed between said first and second focusing electrodes as to be opposed to each other and to form an axial-nonsymmetrical electron lens relative to each of the electron beams; and voltage application means for applying mutually different dynamic voltages to said pair of third focusing electrodes in accordance with the change in the deflection angle of the electron beam emitted from said emission means.

5. An electron gun apparatus according to claim 4, wherein at least one of mutually opposed faces of said pair of focusing electrodes includes a concave groove in the aperture portion for passing the electron beam.

6. An electron gun apparatus according to claim 5, wherein said pair of focusing electrodes include another concave groove different from said concave groove in said aperture portion.

7. An electron gun apparatus according to claim 4, wherein said pair of focusing electrodes include a concave groove extending in the lateral direction in an aperture portion so formed on one of the mutually opposed faces as to pass the electron beam and another concave groove extending in the vertical direction in an aperture portion formed on the other of the mutually opposed faces.

* * * * *